US005355946A

United States Patent [19]

Wei et al.

[11] Patent Number: 5,355,946

[45] Date of Patent: Oct. 18, 1994

[54] TEARDROP-SHAPED HEAT EXCHANGE TUBE AND ITS PROCESS OF MANUFACTURE

[75] Inventors: William Wei, München; Gerhard Pellischek, Wolfratshausen, both of Fed. Rep. of Germany

[73] Assignee: MTU Motoren-und Turbinen-Union Munchen GmbH, Munich, Fed. Rep. of Germany

[21] Appl. No.: 131,286

[22] Filed: Oct. 4, 1993

[30] Foreign Application Priority Data

Oct. 9, 1992 [DE] Fed. Rep. of Germany ..... 4234006

[51] Int. Cl.[5] ..... F28F 1/02

[52] U.S. Cl. ..... 165/172; 165/910

[58] Field of Search ..... 165/172, 910, 173, 185

[56] References Cited

U.S. PATENT DOCUMENTS 3,885,936 5/1975 Linebeer ..... 165/172 X

FOREIGN PATENT DOCUMENTS 0306899 11/1991 European Pat. Off. .

3327660 of 0000 Fed. Rep. of Germany .

3610618 6/1987 Fed. Rep. of Germany .

166907 4/1934 Switzerland ..... 165/183

468980 7/1937 United Kingdom .

748644 5/1956 United Kingdom .

771108 3/1957 United Kingdom .

*Primary Examiner*—John C. Fox

*Attorney, Agent, or Firm*—Ladas & Parry

[57] ABSTRACT

A matrix of heat exchange tubes in a heat exchanger in which a first fluid flows in the heat exchange tubes and undergoes heat exchange with a second fluid flowing externally on the heat exchange tubes. The tubes have a teardrop shape and are arranged in the matrix in parallel relation in rows in which each tube has a rounded surface at one end and a tapered narrow surface at the other end. The tubes in each row all face in the same direction and the tubes in alternate rows face in opposite directions. The tubes have alternate unequal spacing of distances $a_1$ and $a_2$ in successive rows. The tubes can be bent to form a U-shape matrix or a semi-circular matrix. The tubes are each manufactured by filling the space between an inner channel and an outer shell of the tube with a ceramic or metal.

17 Claims, 4 Drawing Sheets

TEARDROP-SHAPED HEAT EXCHANGE TUBE AND ITS PROCESS OF MANUFACTURE

FIELD OF THE INVENTION

The invention relates to a matrix of heat exchange tubes for a heat exchanger in which profiled tubes are arranged in rows, the tubes each having a channel extending in the longitudinal direction of the tube and a symmetrical outer contour of teardrop shape with a sharp rear edge and a blunt front edge. The rear edges of the profiled tubes in the same row point in the same direction and the chordal planes of the profiled tubes are in superposed parallel relation to each other.

The invention also relates to the process of manufacture of such tubes.

BACKGROUND AND PRIOR ART

A number of profiled tubes are known for use in tube heat exchangers, due to the broad application of heat exchangers. Tube heat exchangers which are comprised of a matrix of circular tubes are used in numerous fields such as, for example, in process technology or in heating plant structures. Circular tubes are characterized by low manufacturing costs and high resistance to internal pressure. However, if matrices with circular tubes are subjected to high flow velocity of the surrounding fluid, this leads to undesirably high pressure losses and tuburlence in the flowing fluid. This turbulence may cause vibrations in the tubes of the matrix, which adversely affect the fatigue strength of the matrix and its effectiveness. These conditions have led to more favorably shaped tube profiles, of lancet or oval shape, as disclosed in DE 33 27 660 A1, EP 0 360 899 B1 and DE 36 10 618 A1, Such tube profiles can be produced at low cost by bending processes and they are used in aircraft and spacecraft in cross-counterflow heat exchangers in which the tubes are bent in U-shape, for example, according to DE 36 10 618 A1. Such tubes can also be used in gas turbines and diesel engines of aircraft and vehicles, as well as in stationary plants. However, if lancet, ellipse-shaped or oval profiled tubes are subjected to high internal pressure, the limits to their use are rapidly revealed, since the high pressure leads to expansion deformation, and in the worst case to leakage.

A stacked arrangement of teardrop shaped profiled tubes in a heat exchanger matrix is disclosed in GB 468,980, whereby the flow-favorable shaped profiled tubes with their sharp edges can be aligned either in the direction of flow or opposite the direction of flow.

SUMMARY OF THE INVENTION

An object of the invention is to provide a matrix of heat exchange tubes having capability of high fluid flows without producing vibrations of the tubes.

This object is achieved, according to the invention, in that the rows of profiled tubes are successively spaced at distances $a_1$, $a_2$ from each other and wherein the profiled tubes are aligned in successive rows to face in the direction of flow fluid through the matrix and opposite the direction of flow. Specifically, tubes of teardrop shape are arranged in successive rows to face in opposite directions.

This arrangement of profiled tubes according to the invention produces a compact matrix with a low specific gravity. By virtue of the favorable teardrop contour of the profiled tubes and their arrangement within the matrix according to the invention, only small losses in pressure are produced in the flow on and around the tubes. The front surface of the matrix through which the flow passes can thus be kept small. This is advantageous in vehicle and aircraft drive means with limited space.

The profiled tubes in the rows are preferably uniformly spaced and the tubes in adjacent rows are offset by one-half the spacing between the tubes in the same row. The profiled tubes of adjacent rows can interfit with one another for maximum compaction or they can be spaced apart for minimum tube density in the matrix.

A particularly compact arrangement of profiled tubes with good conditions of fluid flow around the tube profiles is obtained by alternating the orientation of the rows of profiled tubes with respect to the flow direction. The blunt front edges of the profiled tubes in successive rows alternately face in the flow direction of the fluid and opposite the flow direction of the fluid. In this way, a matrix can be employed in a heat exchanger which has an alternating direction of flow, without adversely affecting the mechanical flow properties of the heat exchanger. The service life of the matrix can be considerably lengthened by such a single or multiple reversal of the matrix.

For optimal, undisturbed fluid flow through the matrix, the cross section of the passage through which the fluid passes between the tubes must essentially be kept constant in a direction perpendicular to the flow streamlines over the entire depth of the matrix. For this purpose, the profiled tubes are spaced from each other at unequal distances $a_1$, $a_2$ in the alternating rows.

Because of the outer streamlined, teardrop shape which is favorable for mechanical flow properties, the flow resistance is substantially reduced even for high velocity flow through the matrices, whereby turbulence which produces vibrations, is substantially eliminated. The circular cross section of the channel in the interior of each tube assures the highest possible compressive strength for the channel and maximum deformation resistance. Thus, stringent requirements against leakage especially for the possible use of hydrogen as the fluid flowing through the channels, can be met. The teardrop profile shape also provides a surface to volume ratio which is favorable for heat transfer between the fluid flowing in the channels and the fluid flowing externally around the tubes.

A symmetrical configuration of the profiled tube is advantageous as regards uniform temperature and expansion properties. The profiled tube is thus shaped symmetrically with respect to its chordal plane.

In order to achieve maximum heat exchange in the region of maximum temperature at the front of the profile section at which the fluid passes, the channel is disposed in the vicinity of this region, namely in the region of maximum thickness of the profile section.

By placing the channel in the region of maximum profile thickness, the diameter of the channel can be a maximum. Thus, maximum heat exchange can be obtained.

Gas turbines in vehicles and stationary plants, as well as jet drives with gas turbines, have proven to be fields of use having high optimizing potential. The cooler fluid thus flows through the inside channel of the profiled tubes during which the hot fluid, for example, the turbine exhaust gases, flow on and along the surfaces of the profiled tubes. A profiled tube which is particularly suitable for this or a similar application comprises a channel made of a material of high heat conductivity, a sheet metal shell surrounding the channel in spaced relation and a core of ceramic material filling the space between the shell and the channel.

A further object of the invention is to provide a process for producing a matrix with profiled tubes.

The process of manufacture according to the invention comprises inserting an inner tubular element, which forms the channel, into a closed casting shell defining the outer contour of teardrop shape for the tube and attaching the tubular element and shell together in spaced relation. Then the hollow space between the casting shell and the tubular element is filed with a ceramic or metal powder, which is compacted by applying pressure thereto. Then the compacted powder is hardened and the resulting tube is bent to a desired shape. A plurality of profiled tubes are then assembled into a tube matrix.

This process enables the manufacture of profiled tubes from a small number of constituent pieces at relatively low cost.

Sintering, hot pressing or hot isostatic pressing is particularly suitable for the hardening of the compacted ceramic powder thereby enabling the production of profiled tubes of small cross section.

Another simplification in manufacture is achieved by producing the profiled tube without using a casting shell. In this case, a shell designed as a negative mold is removed from the compacted material after hardening. In this way a lighter construction of the profiled tube can be obtained.

For the manufacture of bent, profiled tubes, the latter are preferably shaped only before or after the compacting. In this way, undesired deformations of the cross section can be extensively avoided.

An alternative approach to the manufacturing process is accomplished by introducing into the hollow space between he shell and the inner tubular element a metal or a metal alloy of high heat conductivity.

This process is particularly suitable for matrices with profiled tubes which are comprised of various materials differing greatly in their properties.

DETAILED DESCRIPTION OF PREFERRED EMBODIMENTS

Figure 1:
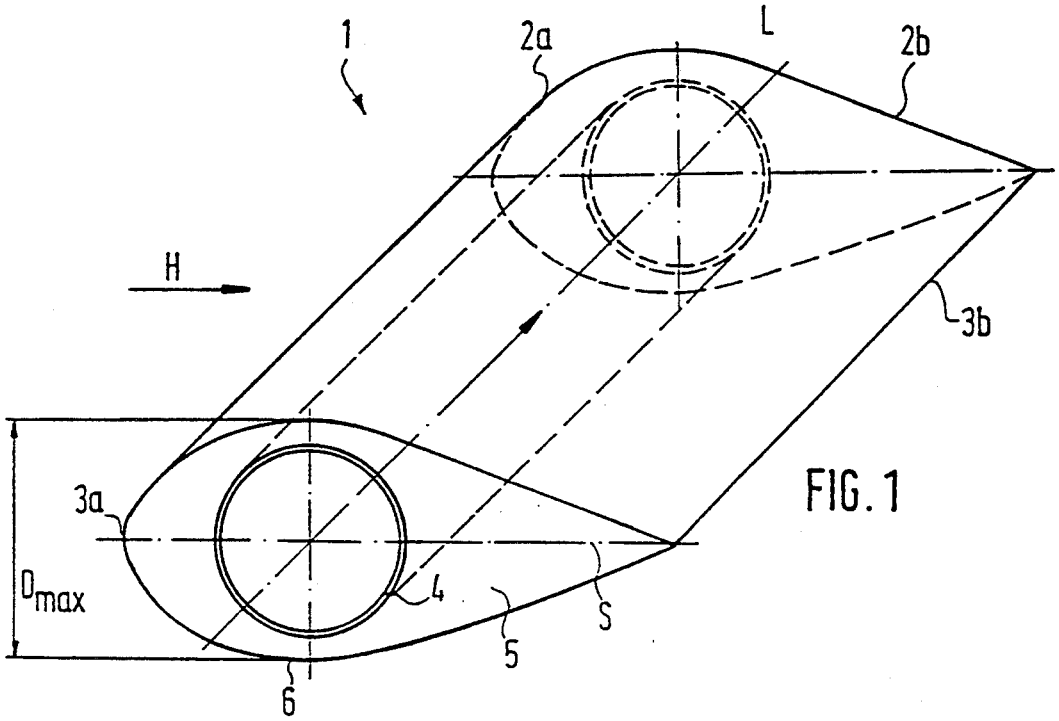
FIG. 1 is a diagrammatic, perspective view of a portion of a profiled tube according to the invention.

FIG. 1 shows a profiled heat exchange tube 1 capable of effecting heat exchange between two flowing fluids. Profiled tube 1 has an aerodynamic cross section similar to that of an aircraft wing, for turbulence-free flow. The outer contour of profiled tube 1 thus extends from a front profiled section 2*a* having a blunt or rounded front edge 3*a* into a narrow, tapered, rear profiled section 2*b* having a sharp rear edge 3*b*. The profile of the tube 1 is symmetrical with respect to a chordal plane S. In the ideal case, flow of a first fluid proceeds in the profiled tube 1 in an inner tubular element or channel 4 in the direction of longitudinal axis L, while a second fluid H flows in the direction of the arrow on and around the profiled tube 1. The second fluid H flows in a direction perpendicular to longitudinal axis L along streamlines extending along chordal plane S. The front profiled section 2*a* is aerodynamically favorably positioned in the flow of fluid H. The tubular element 4 is circular in cross section. In order to produce a symmetrical temperature distribution, the longitudinal axis L of tubular element 4 lies in the chordal plane S. The tubular element 4 is disposed in the profiled tube 1 with its longitudinal axis L located in the region of maximum thickness Dmax of the profiled tube 1. Thereby the tubular element 4 can be produced with the maximum possible diameter.

The tubular element 4 is made of metal and is embedded in a metal core 5, which in turn is covered by a thin sheet metal shell 6. In order to prevent the profiled tube 1 from rupturing due to high internal pressure, the tubular element 4 is provided with a suitable thickness. In one embodiment, the core 5 is made from a metal or a metal alloy, whose melting point is below the operating temperature, so that core 5 is liquefied by the passage of fluid H at a high temperature over the profiled tube 1. In this way, an optimal heat transfer is obtained between the fluid flowing through channel 4 and the fluid H flowing on the surface of the tube 1. A ceramic material or a fiber-reinforced ceramic material may alternatively be utilized for the core, instead of the low-melting point metal.

Figure 2A:
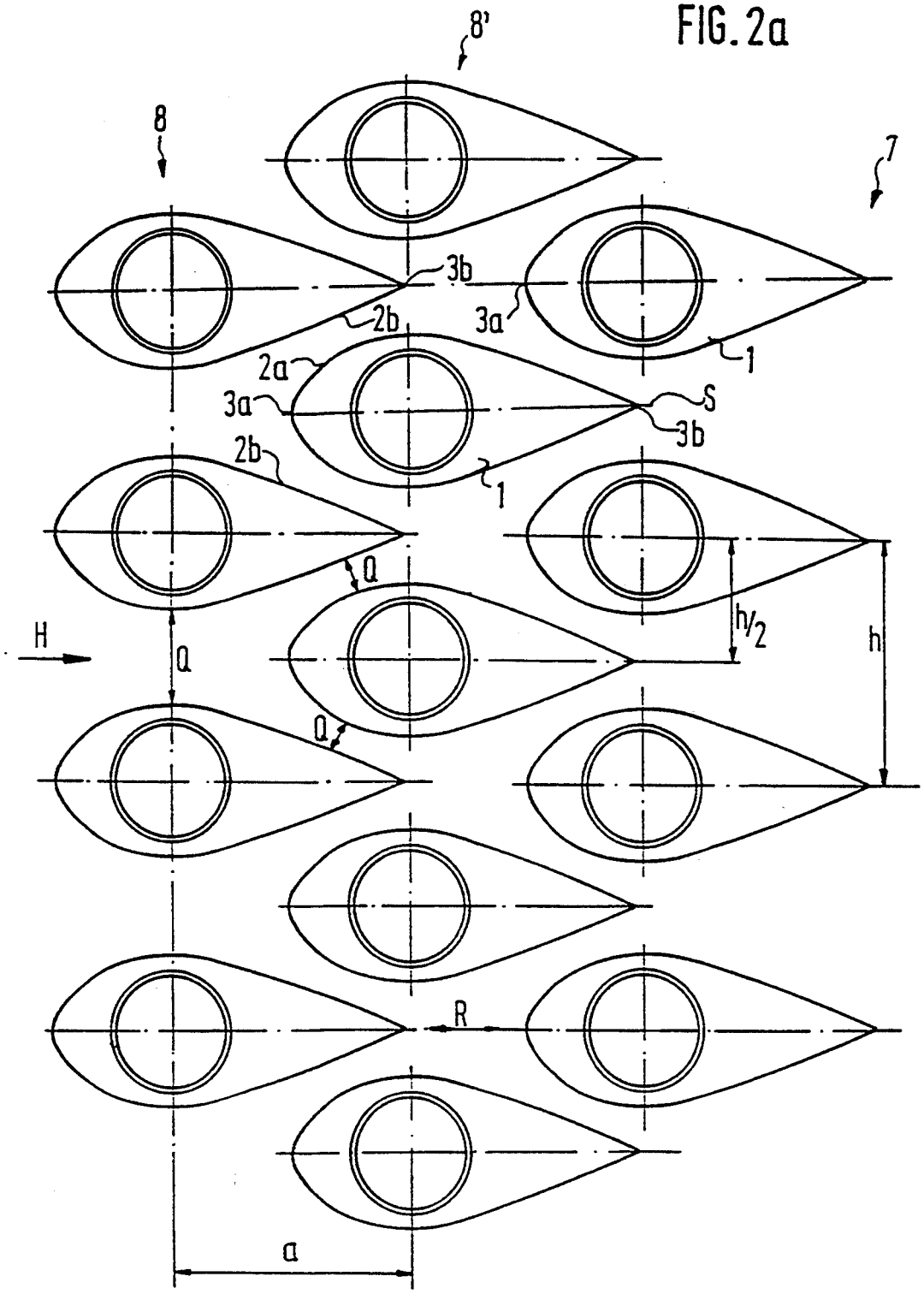
FIG. 2 is a diagrammatic, transverse, sectional view of a portion of a tube matrix whose profiled tubes are all facing the same direction.
FIG. 2*b* is a diagrammatic, transverse, sectional view of a portion of a tube matrix in which the profiled tubes of adjacent rows face in opposite directions.
Figure 2B:
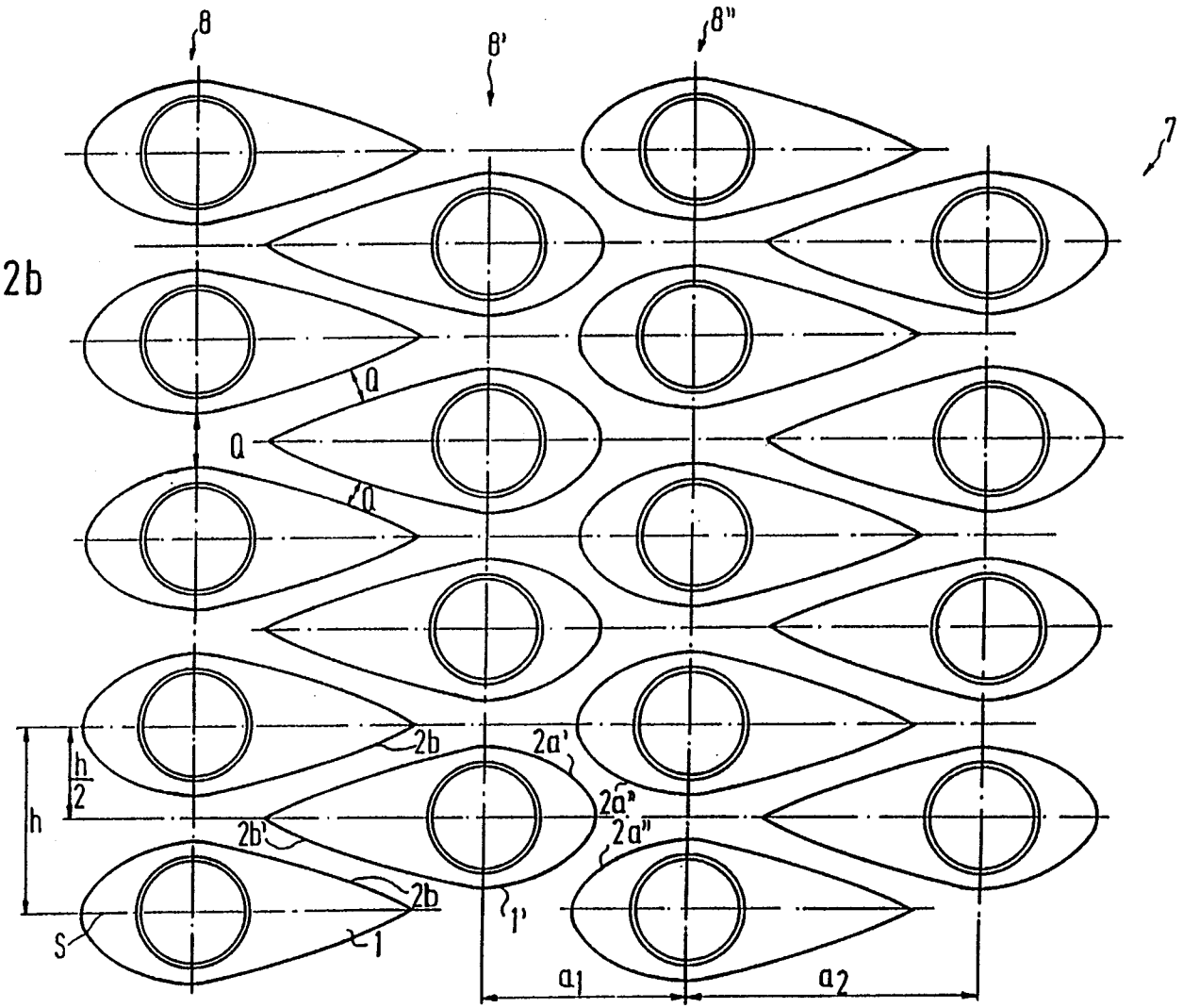

FIGS. 2*a* and 2*b* show two different arrangements of the profiled tubes in tube matrices 7 for a heat exchanger. In order to describe these variants, a partial cross section of a matrix 7 with three rows 8 of profiled tubes (the rows being shown vertically) is shown in FIG. 2*a* while four rows are shown in FIG. 2*b*. The matrices may have any arbitrary number of rows 8 of profiled tubes.

In both cases, matrix 7 consists of a multiple number of rows 8 of profiled tubes, each with a multiple number of profiled tubes 1 arranged uniformly above one another with vertical spacing h. The chordal planes S of all profiled tubes extend parallel to each other. Front edges 3*a* or rear edges 3*b* of the profiled tubes 1 of a common row 8 are arranged above one another in common imaginary planes, which extend perpendicular to chordal planes S. Profiled tubes 1 of adjacent rows 8 face in the same direction in FIG. 2*a*, i.e. towards fluid flow H, whereas in FIG. 2*b* alternate rows 8' of tubes face in opposite directions.

In the arrangement in FIG. 2*a*, the tubes 1 are spaced apart by horizontal distances a in the direction of the chordal plane, and a constant vertical distance h/2 in the direction perpendicular to the chordal plane. The front edges 3*a* of profiled tubes in FIG. 2*a* all face in the same direction, i.e. the gas flow H, the distances a and h being adapted to the cross section of the profiled tubes 1, such that the front profiled sections 2*a* of a row 8' of profiled tubes projects into the intermediate spaces between two rear profiled sections 2*b* of the adjacent profiled tube row 8. The cross sectional areas through which the fluid flow H passes are substantially constant, so that pressure fluctuations are minimal.

This arrangement of profiled tubes in matrix 7 is thus similar to the black or white squares on a checkerboard, except, of course, the vertical distance h/2 is generally not equal to horizontal distance a.

In contrast to the above-described arrangement, in FIG. 2*b* the front edges of profiled tubes 1 alternate in their facing direction in adjacent rows. Thus, the rear profiled section 2*b'* of row 8' of profiled tubes extends into the intermediate spaces between the rear profiled sections 2*b* of adjacent row 8 of profiled tubes. Correspondingly, the profiled sections 2*a''* of row 8'' extend into the intermediate spaces between the front profiled sections 2*a'* of adjacent row 8' of profiled tubes. The profiled tubes are displaced by vertical distance h/2 relative to the profiled tubes 1 of the adjacent row 8 of profiled tubes. The horizontal distances $a_1$ and $a_2$ are variably selected according to the row alignment of the profiled tubes 1, since the horizontal distance $a_1$ between profiled tubes 1 of adjacent rows 8 of profiled tubes (which are arranged with their front profiled sections 2*a* interfitted) is less than the horizontal distance $a_2$ between profiled tubes 1 whose rear profiled sections are interfitted. An optimal adaptation of the flow cross sections that are substantially constant is also obtained in this arrangement so that the sum of the cross-sectional surfaces Q on which fluid H flows remains substantially constant over the depth of the tube matrix.

Figure 3:
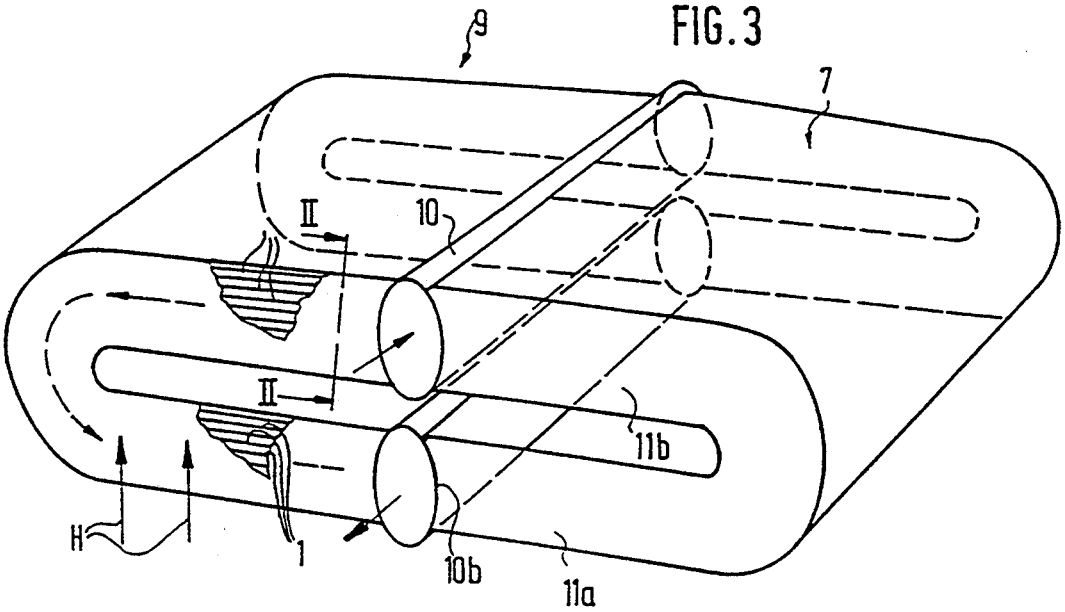
FIG. 3 is a diagrammatic, perspective view of a heat exchanger with U-shaped heat exchanger tubes.

FIG. 3 shows the above-described matrix 7 in a cross-counterflow heat exchanger 9, through which a hot gas H flows. Heat exchanger 9 includes two parallel ducts 10*a* and 10*b* for conveying a cooling fluid or a fluid to be heated, such as compressed air into and out of the heat exchanger. A matrix 7 with profiled tubes 1 extends at each side of the ducts 10*a* and 10*b*. Ducts 10*a*, 10*b* are each closed at their rear ends. The matrices 7 project in U form at both sides of ducts 10*a*, 10*b* crosswise to the flow of hot gas H. Each matrix 7 consists of rows of U-shaped bent profiled tubes 1. During operation, the cooling fluid or compressed air to be heated is fed into the upper duct 10*a*, then flows through the profiled tubes 1 crosswise to the hot gas flow H into lower duct 10*b* in the heated state from where it is fed to a utilization means, such as the combustion chamber of a gas-turbine drive mechanism.

A cross section taken along line 11—11 through matrix 7 in FIG. 3 corresponds to the representation of the profiled tube arrangement according to FIGS. 2*a* or 2*b* (turned 90°), whereby the chordal planes S of profiled tubes 1 extend parallel to the direction of flow of hot gas H. Thus, the chordal planes S lie in the plane of the parallel legs of the U-shaped profiled tubes 1. Thereby, the rear edge or the front edge 3*b* or 3*a* extends constantly inside the bend. In this way, the flow of hot gas H passes on the rear edge or front edge side in leg 11*a* in upward flow, and the hot gas H passes through profiled tubes 1 in leg 11*b* at the front edge or rear-edge side i.e. in reverse orientation. The alternating alignment of the rows of profiled tubes according to FIG. 2*b* is particularly favorable for a uniform flow through legs 11*a* and 11*b*.

Figure 4:
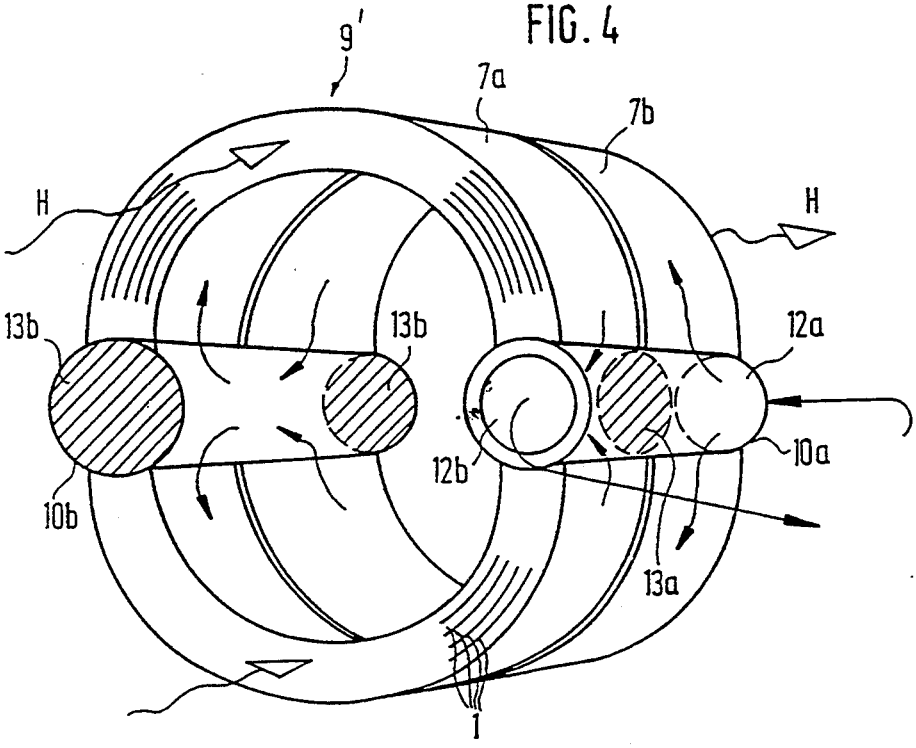
FIG. 4 is a diagrammatic, perspective view of a drum heat exchanger with heat exchange tubes bent into circular shape.

A drum heat exchanger 9 is shown in FIG. 4. In this arrangement, two arcuate or circular matrices 7*a*, 7*b* are connected in series to a cross-counterflow heat exchanger 9' by means of two parallel ducts 10*a*, 10*b*. Profiled tubes 1 of matrices 7*a*, 7*b* are bent in an arcuate shape, preferably circular, and their ends open respectively into the diametrically opposed ducts 10*a* and 10*b*. Matrices 7*a*, 7*b* consist of profiled tubes 1 arranged in rows, as shown in FIGS. 2*a* or 2*b*. The flow of gas H passes axially through the matrices 7*a*, 7*b*, whose chordal planes S are aligned in the axial direction, so that the chordal plane S can be represented as portions of concentric cylinders.

During operation, the cooling fluid or the compressed air flows through heat exchanger 9' as follows:

The cooling fluid or compressed air enters the heat exchanger 9 at end 12*a* of first duct 10*a* in a direction opposite hot gas flow H. The cooling fluid or compressed air flows through the profiled tubes of matrix 7*b* in a circumferential direction to the second duct 10*b*. The fluid then flows in duct 10*b* into the profiled tubes 1 of matrix 7*a* and it then flows through the latter in the opposite circumferential direction until it re-enters duct 10*a* and leaves the heat exchanger 9' via end 12*b* of duct 10*a* in the heated state. In order to separate the fluid flow in the first duct 10*a*, the latter is divided by a partition 13*a* shown by hatched lines between the two matrices 7*a*, 7*b*. The second duct 10*b* is closed at both ends by covers 13*b* also shown by hatched lines.

Profiled tubes 1 can be manufactured by bending the outer sheet metal shell 6 into the form of the teardrop profile and welding it at the sharp rear edge 3*b*. Then, the inner tubular element or channel 4 is inserted inside shell 6 and welded or otherwise secured in spaced relation in the shell 6. Subsequently, the hollow space between inner tubular element 4 and shell 6 is filled with a ceramic powder such as $Al_2O_3$, SiC or TiC, and the powder is compacted by application of pressure to the shell 6. The thus compacted powder is then hardened by sintering. Finally, the profiled tube 1 is bent into the desired shape i.e. U-shape or semi-cylindrical shape.

In an alternative manufacturing process, the space between the sheet metal shell 6 and tubular element 4 is filled with a low-melting point metal. Then the profiled tube 1 is bent into the desired shape.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. A matrix of heat exchange tubes in a heat exchanger in which a first fluid flowing in the heat exchange tubes undergoes heat exchange with a second fluid flowing externally on the heat exchange tubes, said tubes being of teardrop shape and arranged in said matrix in parallel relation in rows in which each tube has a rounded surface at one end and a tapered narrow surface at the other end, the tubes in each row all facing in the same direction, the tubes in alternate rows facing in opposite directions.

2. A matrix as claimed in claim 1, wherein successive rows of tubes have alternate unequal spacing of distances $a_1$ and $a_2$.

3. A matrix as claimed in claim 2, wherein the tubes in each row have equal spacing h and the spacing between the tubes in adjacent rows is h/2.

4. A matrix as claimed in claim 2, wherein the tapered narrow surfaces of the tubes in one row extend between the tapered narrow surfaces of the tubes of an adjacent row at one side thereof, and the rounded surfaces of the tubes in said one row extend between the rounded surfaces of the tubes of an adjacent row at the other side thereof.

5. A matrix as claimed in claim 4, where the rows of tubes are spaced from one another so that the sum of cross sectional areas through which the second fluid flows around said tubes remains substantially constant through the matrix.

6. A matrix as claimed in claim 1, wherein the tubes in said matrix have a U-shaped profile including parallel legs and a bend region, said tubes having chordal planes which pass through both legs of the U-shaped profile.

7. A matrix as claimed in claim 1, wherein the tubes in said matrix extend in concentric semi-circular rows and have chordal planes extending in said rows along concentric cylindrical surfaces.

8. A matrix as claimed in claim 1, wherein each tube comprises a cylindrical channel for flow of said first fluid therein.

9. A matrix as claimed in claim 8, wherein each heat exchange tube has a chordal plane containing an axis of said cylindrical channel.

10. A matrix as claimed in claim 9, wherein said channel is located in each said tube closer to the end of rounded surface than to the end of tapered narrow surface.

11. A matrix as claimed in claim 10, wherein each tube has a region of maximum profile thickness at which said channel is located.

12. A matrix as claimed in claim 1, wherein each tube comprises a one-piece element.

13. A matrix as claimed in claim 1, wherein each tube comprises an inner tubular element and an outer element surrounding said tubular element, said outer element having an outer surface of said teardrop shape.

14. A matrix as claimed in claim 13, comprising on each tube an outer shell on said outer element.

15. A matrix as claimed in claim 14, wherein said inner tubular element is made of a metal of high heat conductivity, said shell is made of sheet metal, and said outer element is made of a ceramic material.

16. A matrix as claimed in claim 14, wherein said inner tubular element is made of a metal of high heat conductivity, said shell is made of sheet metal, and said outer element is made of a material having a low melting point so that said material is molten during flow of said first and second fluids.

17. A matrix as claimed in claim 14, wherein said outer shell is made of a ceramic material with or without fiber reinforcement.

* * * * *